US006419323B1

(12) United States Patent
Chu et al.

(10) Patent No.: US 6,419,323 B1
(45) Date of Patent: Jul. 16, 2002

(54) ELEVATION MECHANISM FOR ARMCHAIR ARMREST

(75) Inventors: Jung-Hua Chu, 55-3, Sa Run Rd., Chung Sa Village, An Ding Shian, Tainan Hsien (TW); Hua-Su Pung, Tainan Hsien (TW)

(73) Assignee: Jung-Hua Chu, Tainan Hsien (TW)

( * ) Notice: Subject to any disclaimer, the term of this patent is extended or adjusted under 35 U.S.C. 154(b) by 0 days.

(21) Appl. No.: 09/865,741

(22) Filed: May 25, 2001

(51) Int. Cl.[7] ..... A47C 7/54
(52) U.S. Cl. ..... 297/411.36; 297/411.35
(58) Field of Search ..... 297/411.36, 411.35, 297/353

(56) References Cited

U.S. PATENT DOCUMENTS

| | | | | | |
|---|---|---|---|---|---|
| 5,318,347 | A | * | 6/1994 | Tseng | 297/411.36 |
| 5,393,124 | A | * | 2/1995 | Neil | 297/411.36 |
| 5,435,626 | A | * | 7/1995 | Lai | 297/411.26 |
| 5,620,233 | A | * | 4/1997 | Corwin | 297/411.36 |
| 5,895,095 | A | * | 4/1999 | Chen | 297/411.36 |
| 6,035,579 | A | * | 4/2000 | Nelson et al. | 297/411.36 |

* cited by examiner

*Primary Examiner*—Peter R. Brown
(74) *Attorney, Agent, or Firm*—Alan Kamrath; Rider Bennett Egan & Arundel, LLP

(57) ABSTRACT

This invention provides an elevation mechanism for an armchair armrest, comprising a T-shaped post, a catch cylinder, an adjustment unit, a reflex plate, a U-shaped block and a resilient spring that are fastened by a plurality of screws. At the center of the T-shaped post is a U-shaped depression, on which are a first screw hole, a cross through hole and a second screw hole spaced from top to bottom. The first screw hole serves to fasten a first screw inserted in a first through aperture on the adjustment unit. The vertical slot of the cross through hole accommodates the insertion of the depressed groove of the adjustment unit. The horizontal slot of the cross through hole accommodates a U-shaped block that goes with the depressed groove. At the center of the adjustment unit is a third screw hole to accommodate and fasten a second screw inserted through the second through hole on the reflex plate. A third screw runs into the bottom hook of the resilient spring and into the screw hole on the T-post, while the top hook of the resilient spring is hooked onto the protruded block on the adjustment unit. At the top of the back of the catch cylinder are a pin insert groove and a spring sleeve, to bury the insert pin, spring and steel ball. The entire assembly is inserted in the protective cylinder, to become an excellent mechanism that enables free adjustment of the height of the armrest.

1 Claim, 4 Drawing Sheets

Prior Art

ELEVATION MECHANISM FOR ARMCHAIR ARMREST

BACKGROUND OF THE INVENTION

1. Field of the Invention

This invention provides an elevation mechanism for an armchair armrest, particularly a mechanism that enables the user to adjust the height of an armchair armrest at any time.

2. Background of the Invention

As shown in FIGS. 6 and 7, the conventional elevation mechanism for an armchair armrest is designed to include a base unit 36 at the bottom of a T-shaped post 35, which accommodates the insertion of a rod 37. The combination of a semi-circular slide track 38 and a semi-circular seat 41 is wrapped by a protective cylinder 42. Inside the semi-circular slide track 38 is a check track 39 and a slide track 40. With the above design, the rod 37 inserted on the base unit 36 of the T-shaped post 35 works with the slide track 40 and the check track 39 of the semi-circular slide track 38 to adjust the height of an armrest. However, such design has the following shortcomings.

The mechanism of such design can elevate the height, but it must be pulled to the top when it goes beyond a specified height. Thus, the armrest must be reduced to the bottom before the armrest can be adjusted upward again.

During the process when moving the chair within an area or between areas, most people would hold on to the armrest, which may cause damage to said mechanism, resulting in failure to adjust the height of the armrest.

In view of the defective design and its shortcomings, the inventor has devoted to seek a better design for improvement.

BRIEF DESCRIPTION OF THE INVENTION

The objective of this invention is to provide an elevation mechanism for an armchair armrest which can adjust the height of the armrest without having to repeat the adjustment process once the height is adjusted to a level higher than a specified height, so that the user can elevate or lower the armrest at any time.

BRIEF DESCRIPTION OF DRAWINGS

The drawings of preferred embodiments of this invention are described as follows.

BRIEF DESCRIPTION OF NUMERALS

| | | | |
|---|---|---|---|
| 1 | T-shaped post | 2 | U-shaped depression |
| 3 | first screw hole | 4 | cross through hole |
| 5 | second screw hole | 6 | screw hole |
| 7 | screw hole | 8 | catch cylinder |

-continued

BRIEF DESCRIPTION OF NUMERALS

| | | | |
|---|---|---|---|
| 9 | top through hole | 10 | bottom through hole |
| 11 | catch groove | 12 | pin insert groove |
| 13 | spring sleeve | 14 | insert pin |
| 15 | spring | 16 | steel ball |
| 17 | check groove | 18 | adjustment unit |
| 19 | first screw | 20 | first through aperture |
| 21 | third screw hole | 22 | depressed groove |
| 23 | U-shaped block | 24 | reflex plate |
| 25 | second through aperture | 26 | second screw |
| 27 | protruded block | 28 | top hook |
| 29 | bottom hook | 30 | resilient spring |
| 31 | third screw | 32 | check slot |
| 33 | turning groove | 34 | protective cylinder |
| 35 | T-shaped post | 36 | base unit |
| 37 | rod | 38 | semi-circular slide track |
| 39 | check track | 40 | slide track |
| 41 | semi-circular seat | 42 | protective cylinder |

DETAILED DESCRIPTION OF PREFERRED EMBODIMENTS

Figure 1:
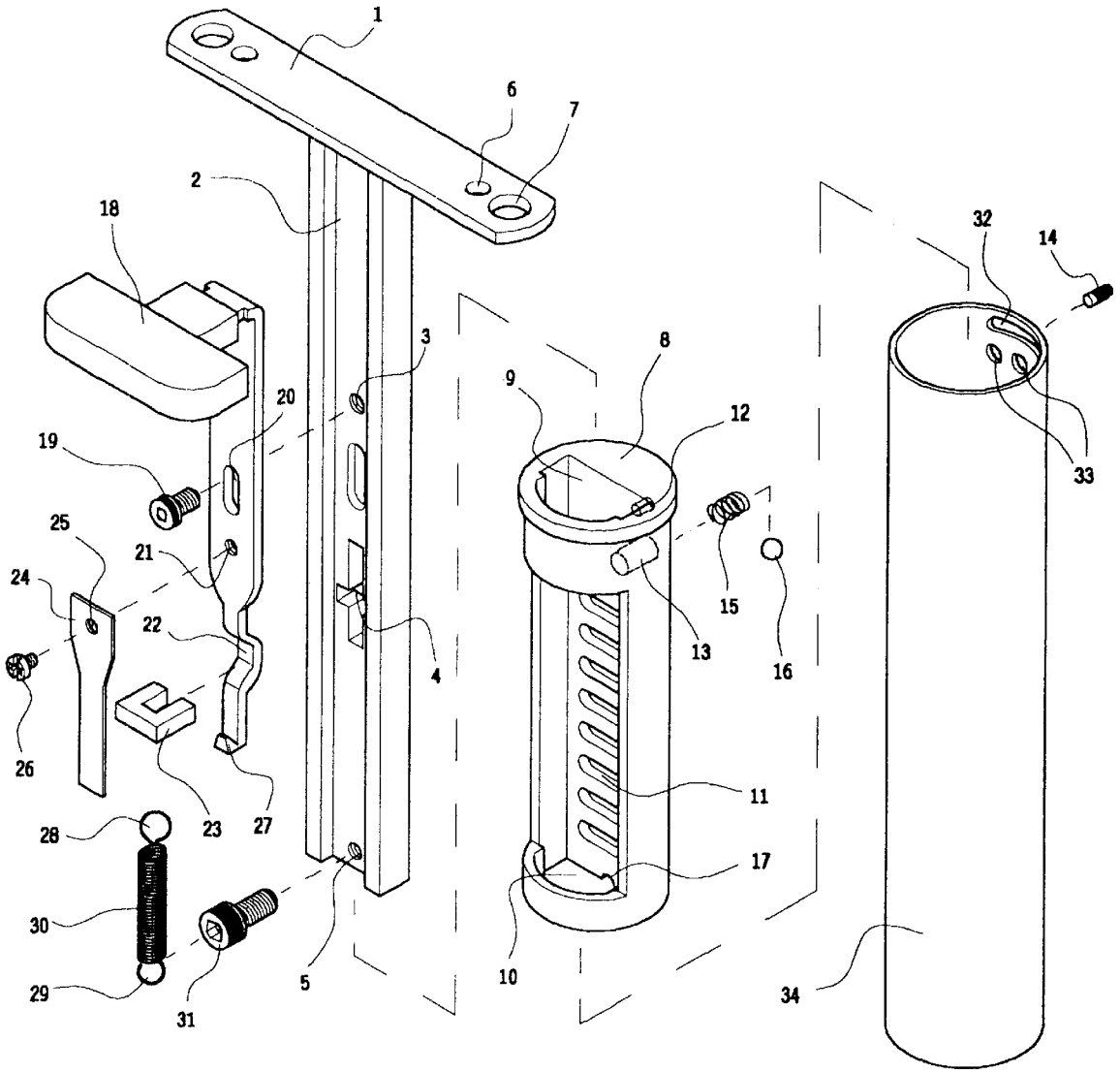
FIG. 1 is an exploded perspective view of the invention.
Figure 2:
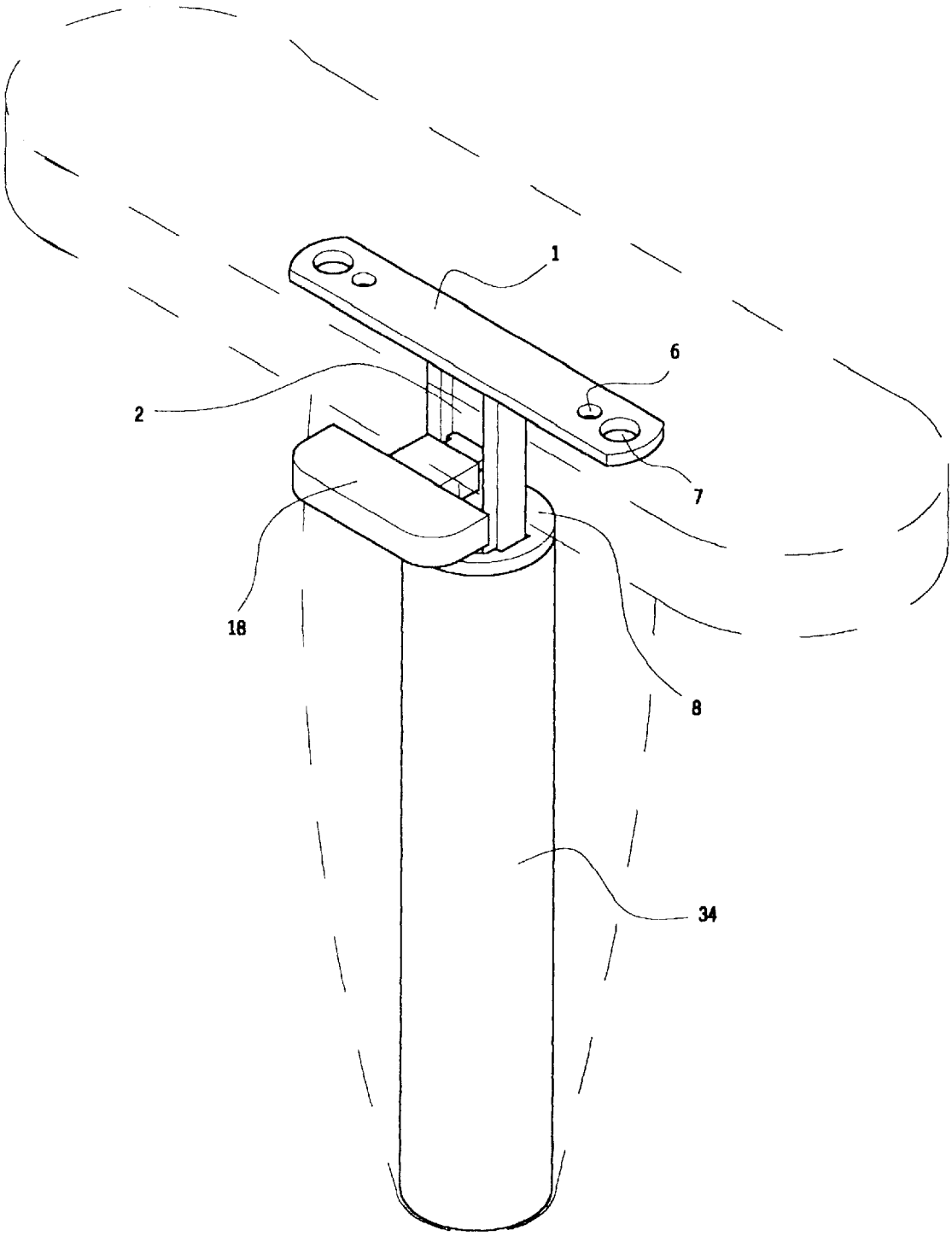
FIG. 2 is a perspective view of the invention.
Figure 5:
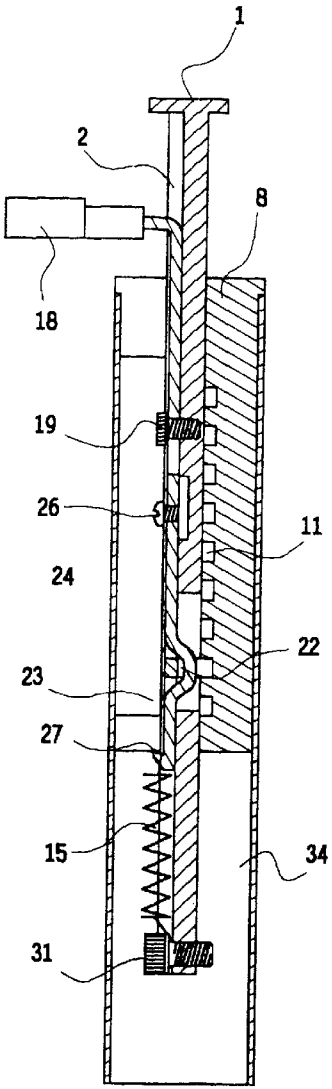
FIG. 5 is a third schematic section view of the invention.
Figure 4:
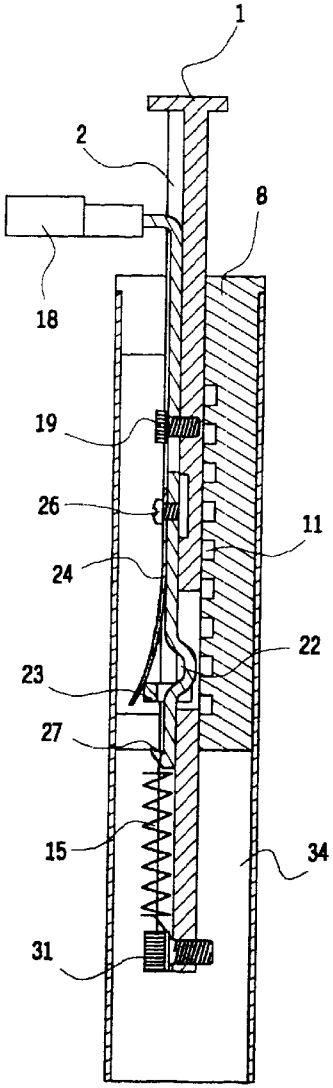
FIG. 4 is a second schematic section view of the invention.
Figure 3:
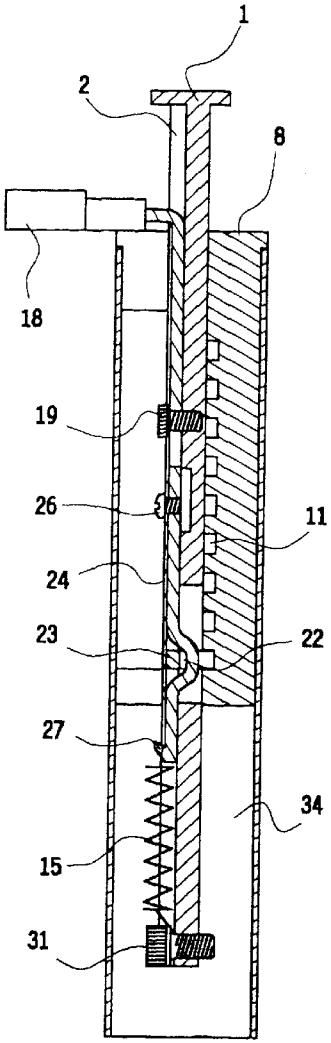
FIG. 3 is a first schematic section view of the invention.
Figure 6:
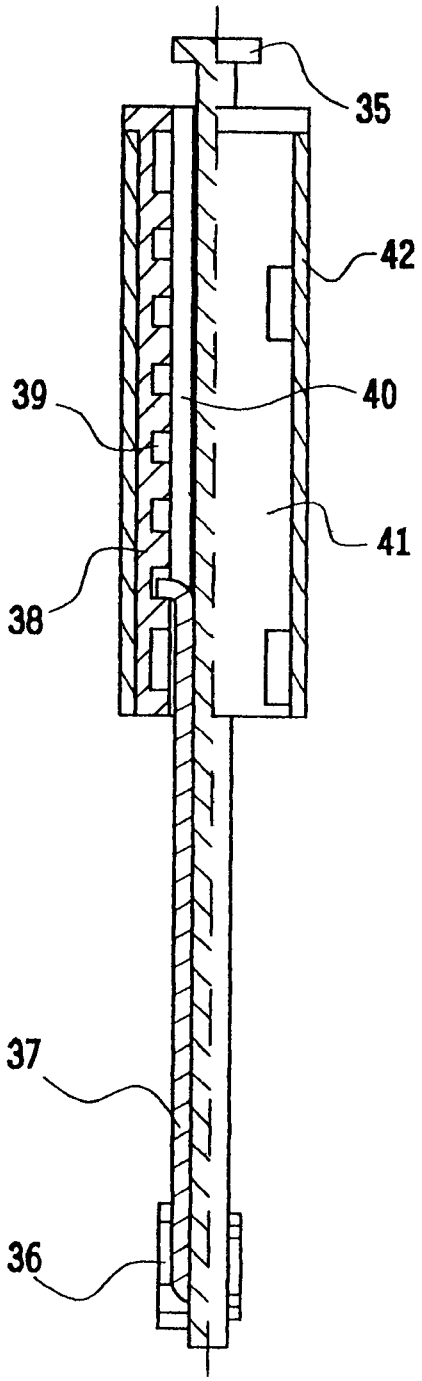
Fig 6 Prior Art
FIG. 6 is a first schematic section view of a conventional elevation mechanism.
Figure 7:
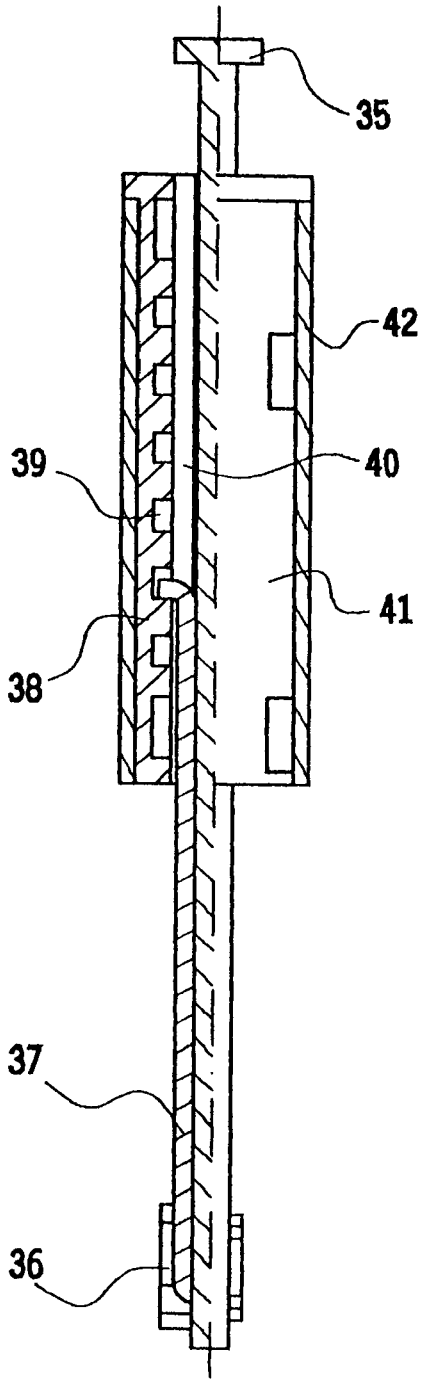
FIG. 7 is a second schematic section view of a conventional elevation mechanism.

As shown in FIGS. 1 through 5, this invention comprises a T-shaped post 1, a catch cylinder 8, an adjustment unit 18, a reflex plate 24, U-shaped block 23 and a resilient spring 30, which are tightened by a plurality of screws. At the lower part of the T-shaped post 1 is a U-shaped depression 2, with holes located from top to bottom at its center, including a first screw hole 3, a cross through hole 4 and a second screw hole 5. The first screw hole 3 serves to fasten a first screw 19 running through a first through aperture 20 on the adjustment unit 18. A vertical slot of the cross through hole 4 serves to accommodate a depressed groove 22 on the adjustment unit 18. A horizontal slot of the cross through hole 4 serves to accommodate a U-shaped block 23 that goes with the depressed groove 22 into the cross through hole 4. At the center of the adjustment unit 18 is drilled a third screw hole 21, which serves to fasten a second screw 26 that is inserted into a second through aperture 25 on the reflex plate 24. The T-shaped post 1 is inserted inside the catch cylinder 8, and a third screw 31 is inserted into a bottom hook 29 on the resilient spring 30, and into the second screw hole 5 at the bottom of the T-shaped post 1. The top hook 28 of the resilient spring 30 is engaged to a protrusion block 27 at the bottom of the adjustment unit 18. On the top of the back of the catch cylinder 8 are a pin insert groove 12 and a spring sleeve 13. The pin insert groove 12 serves to accommodate the insertion of an insert pin 14. A spring 15 and a steel ball 16 are buried inside the spring sleeve 13. Then, the assembled mechanism is inserted inside a protective cylinder 34. On the top of the back of the protective cylinder 34 are a check slot 32 and a turning groove 33. The check slot 32 serves to contain and restrict the insert pin 14 within, to prevent over-turning of the armrest. The turning groove 33 serves to catch the steel ball 16 within to achieve a turning function of the armrest.

The aforementioned mechanism has proved to have better effects than conventional products, including the following:

With this invention, the catch groove 11, the adjustment unit 18, the reflex plate 24, the protruded block 27, and the resilient spring 30 installed within the catch cylinder 8 make it possible to adjust the height of the armrest at any time.

The aforementioned mechanism of this invention can achieve excellent fixing and fastening effects, avoiding the shortcomings of conventional products, such as impact to the user's head when the product is being handled, as well as reduced service life of the mechanism.

With this invention, the user can feel free at any time to adjust the height of the armrest to suit the user's need in a speedy and correct way.

To conclude, the winning features and performance of this invention include a steady mechanism, secure engagement, free adjustment of height at any time, and speedy and correct adjustment. Therefore, this invention is indeed an inventive and practical creation.

What is claimed is:

1. An elevation mechanism for an armchair armrest, comprising a T-shaped post, a catch cylinder, an adjustment unit, a reflex plate, a U-shaped block and a resilient spring, at a center on a lower part of the T-shaped post being a U-shaped depression running from top to bottom, at the center of the U-shaped depression being a first screw hole, a cross through hole and a second screw hole, the first screw hole serving to fasten a first screw inserted in a first through aperture of the adjustment unit, a vertical slot of the cross through hole serving to accommodate a depressed groove of the adjustment unit, a horizontal slot of the cross through hole serving to accommodate a U-shaped block that goes together with the depressed groove, at a center of the adjustment unit being a third screw hole that accommodates a second screw that goes through a second through aperture of the reflex plate, the T-shaped post being inserted inside the catch cylinder, a third screw inserted into a bottom hook of the resilient spring and into the second screw hole at the bottom of the T-shaped post, a top hook of the resilient spring being engaged to a protruded block at a bottom of the adjustment unit, on a top of a back of the catch cylinder being a pin insert groove and a spring sleeve to accommodate an insert pin, while a spring and a steel ball are buried inside the spring sleeve, and the assembled mechanism being inserted inside a protective cylinder, a top of a back of the protective cylinder being a check slot and turning grooves, the check slot serving to restrict the insert pin within, to avoid over-turning of the armrest, while the turning grooves serve to trap the steel ball within to achieve a turning function of the armrest.

* * * * *